United States Patent [19]

Hardie et al.

[11] Patent Number: 4,884,574

[45] **Date of Patent: * Dec. 5, 1989**

[54] VIBRATORY SAUNA

[76] Inventors: Laurie S. Hardie, 8 View Avenue, Surfers Paradise, Queensland; Leonard J. Coleman, 5 Seafarer Court, Paradise Waters, Queensland, both of Australia, 4217

[ * ] Notice: The portion of the term of this patent subsequent to Dec. 15, 2004 has been disclaimed.

[21] Appl. No.: 130,075

[22] Filed: Dec. 8, 1987

Related U.S. Application Data

[60] Division of Ser. No. 772,726, Sep. 4, 1985, Pat. No. 4,712,538, which is a continuation-in-part of Ser. No. 551,958, Nov. 15, 1983, Pat. No. 4,565,188.

[51] Int. Cl.[4] ..... A61H 33/06

[52] U.S. Cl. ..... 128/373; 128/24.1; 5/451; 4/529

[58] Field of Search ..... 128/24.1, 24.2, 33, 128/24 R, 32, 368, 371, 373, 374, 376; 4/524, 529, 533, 531; 5/451, 453

[56] References Cited

U.S. PATENT DOCUMENTS

| | | | |
|---|---|---|---|
| 318,760 | 5/1885 | Lester | 4/530 |
| 1,364,365 | 1/1921 | Golden | 4/528 |
| 1,421,502 | 7/1922 | Kruse | 4/529 |
| 1,643,399 | 9/1927 | Wentworth | 128/24.1 |
| 1,708,624 | 4/1929 | Kruse | 4/530 |
| 1,797,153 | 3/1931 | Nogradi | 4/529 |
| 1,797,916 | 3/1931 | Kruse | 4/530 |
| 2,096,128 | 10/1937 | Mortrude, Jr. | 128/24.1 |
| 2,235,184 | 3/1941 | Wettlaufer | 128/33 |
| 2,300,445 | 11/1942 | Lukats | 4/525 |
| 2,300,455 | 11/1942 | Lukats | 4/525 |
| 2,332,231 | 11/1943 | Berg | 128/38 |
| 2,333,231 | 11/1943 | Berg | 128/38 |
| 2,346,827 | 4/1944 | Cotter | 4/529 |
| 2,500,508 | 3/1950 | Bachin | 128/33 |
| 2,501,989 | 3/1950 | Burns | 4/530 |
| 2,571,757 | 10/1951 | Pruitt | 128/33 |
| 2,640,201 | 6/1953 | Burwell | 128/373 |
| 2,674,993 | 4/1954 | Harrell | 128/33 |
| 2,814,297 | 11/1957 | Stewart | 4/531 |
| 2,821,982 | 2/1958 | St. John Lyburn | 4/531 |
| 2,908,271 | 10/1959 | Ware | 128/33 |
| 3,043,293 | 7/1962 | Rider | 128/33 |
| 3,051,180 | 8/1962 | Adams-Ray et al. | 128/373 |
| 3,732,860 | 5/1973 | Thurmer | 128/33 |
| 3,826,250 | 7/1974 | Adams | 128/33 |
| 3,872,526 | 3/1975 | Betts | 5/451 |
| 3,986,513 | 10/1976 | Stuhl | 128/373 |
| 4,044,772 | 8/1977 | Schloss | 4/524 |
| 4,105,024 | 8/1978 | Raffel | 5/451 |
| 4,277,855 | 7/1981 | Poss | 4/524 |
| 4,507,816 | 4/1985 | Smith, Jr. | 5/451 |
| 4,565,188 | 1/1986 | Hardt | 4/524 |
| 4,607,405 | 8/1986 | Ellis et al. | 5/451 |
| 4,635,620 | 1/1987 | Ricchio | 5/451 |
| 4,671,284 | 6/1987 | Wilson et al. | 128/373 |
| 4,757,548 | 7/1988 | Fenner, Jr. | 5/451 |

*Primary Examiner*—Edgar S. Burr
*Assistant Examiner*—Kimberly L. Asher
*Attorney, Agent, or Firm*—Lackenbach, Siegel, Marzullo & Aronson

[57] ABSTRACT

A vibratory sauna having a cover rotatably connected to a lower housing that supports an elongate member adapted to support the torso of a person using the sauna. The cover forms a compartment that passes hot air over the torso by way of a blower mounted in a longitudinal air duct that is positioned in a chamber formed by the lower housing and the elongate member. Hot air coils are in the duct. The elongate member is resiliently supported by the lower housing so that a vibratory device causes the elongate member to move at a predetermined tempo. A head support extends longitudinally from the lower housing. One or more systems, such as a face fan, air purifier, radio and/or cassette player with stereo speakers, amy also be provided, if desired, and controls for all such systems may be suitably disposed on the inside of the cover for access during use of the vibratory sauna. The vibratory sauna may include a water bed positioned on the elongate member with a pulsating mechanism creating rhythmical pulsations in the liquid.

20 Claims, 9 Drawing Sheets

VIBRATORY SAUNA

This is a division of application Ser. No. 772,726 filed Sept. 4, 1985, new U.S. Pat. No. 4,712,538 which is continuation-in-part of Ser. No. 551,958, filed 11/15/83, now U.S. Pat. No. 4,565,188.

BACKGROUND OF THE INVENTION

This invention relates to a vibratory sauna, and in particular to a sauna suitable for providing motion to a person using the sauna, which aids in relaxation and enjoyment of the sauna.

The vibrator sauna of the prior application discloses a novel and universal machine that generally stimulates exercise without putting stress on the body. Also, the vibratory sauna may be employed as an efficient method of losing weight, since the vibration and heat can be programmed to simulate the effects of a stimulating jogging without any harmful side effects.

Other improved features and modifications include a more detailed embodiment related to the elongated tunnel chamber described in said earlier filed application. Also, inside controls have been added along with a face fan. Stereo and audio cassette features are also provided. The sauna is also preferably formed from either a suitable plastic or pressed from a fiberglass composition.

The following references are noted to relate to the subject matter of this patent application:

(1) "Physical Therapeutic Table," U.S. Pat. No. 2,500,508, issued to P. Bachin on Mar. 14, 1950;

(2) "Dry Air Therapeutic Cabinet," U.S. Pat. No. 2,814,297 issued to E. A. Stewart on Nov. 26, 1957; and (3) "Vapor Bath Cabinet," U.S. Pat. No. 1,797,153, issued to M. Nogradi on Mar. 17, 1931.

(4) "Apparatus," U.S. Pat. No. 3,826,250, issued to H. Adams on July 30, 1974;

(5) "Electrophysical Cabinet," U.S. Pat. No. 2,096,128 issued to W. G. Mordrodo, Jr. on Oct. 29, 1937; and (6) "Therapeutic Vibrator," U.S. Pat. No.2,235,184, issued to W. L. Wettlaufor on Mar. 18, 1941.

None of the patents listed above disclose a sealed air duct that passes return cooled air from the upper hot air compartment in which the user lies through the lower chamber below the upper compartment. The ducting contains both a blower and heating coils and directs the heated air to the upper compartment from where the air returns to the suction side of the blower. The duct is sealed from the lower chamber so that very efficient movement and heating of the air occurs.

Also, the art noted hereinabove does not provide cooling for the head of a user in the sauna.

Furthermore, none of the art includes controls inside the upper hot air compartment that provide easy access to a person using the sauna to adjust vibration rate, blower speed, heat, and stereo cassette track and/or volume.

SUMMARY OF THE INVENTION

Accordingly, it is a principle object of the present invention to provide an improved vibratory sauna.

It is another object of the present invention to provide an improved vibratory sauna having ducting positioned in and isolated from the lower unheated chamber so as to improve the efficiency of air movement; to prevent heat losses through the outside walls of the vibrator; and to provide control of the movement of the air.

It is another object of the present invention to provide an improved vibratory sauna having a built-in stereophonic cassette capable of playing a selected tape having a tempo in rhythm to the frequency of the vibrator.

It is still another object of the present invention to provide an improved vibratory sauna having controls for regulating vibrator rhythm, hot air blower, heat regulator, and stereo cassette volume located inside the lid.

It is still another object of the present invention to provide a digital readout panel for blower speed, vibrator tempo, and temperature that is readable during use by the user of the sauna.

In order to achieve the above objects, as well as others that will become apparent hereafter, a vibratory sauna is provided that includes a housing including a lower housing member and an upper closure member rotatably connected to the lower housing member. The lower housing member includes a base. A support member is mounted on the lower housing member oriented in a substantially horizontal plane for supporting the torso of a person in a supine position. Head support means is located adjacent to the lower housing member and outwardly of the closure member to form a longitudinal extension of the support member. Resilient mounting means is positioned in the lower housing member for supporting the support member. Vibration means is operatively connected to the support member for vibrating the support member. The cover member forms an upper compartment, the torso being positioned in the compartment. The lower housing member forms a chamber below the support member. Heating means is provided for heating unheated air. Airflow generation means forces heated and unheated air. Chamber means is positioned within and sealed from the chamber. The heating means is positioned in the chamber means and the air blow generation means is associated with an inlet and of the chamber means. The chamber means is for receiving unheated air from the compartment at the inlet end and passing the unheated air to an opposite outlet end back to the compartment in a longitudinal flow of air as one part of a continuous closes circulation loop of air in the housing. The loop including a flow of heated air above the support member to contact the person lying thereon while the support member is adapted to be simultaneously vibrated. The flow of heated air above the person includes the other part of the continuous circulation loop.

Other improvements of the vibratory sauna of the present invention include a closure member which is a cover hingedly mounted to the lower housing member at an end of the housing opposite to the head support means. The lower housing member includes opposed longitudinal side walls, a pair of opposed longitudinal horizontal shelves extending from said longitudinal side walls into the chamber; and an elongated support member is generally positioned and held by the pair of shelves. Resilient mounting means includes resilient means interposed between the elongate member and the pair of shelves; and the resilient means engage in a corresponding plurality of sockets provided on both the elongate member and the shelves for mutual cooperative association with the resilient means.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teachings herein, and such other embodiments or modifications are intended to be reserved especially as they fall within the scope and spirit of the subjoined claims.

DETAILED DESCRIPTION OF THE PREFERRED EMBODIMENT

Figure 1:
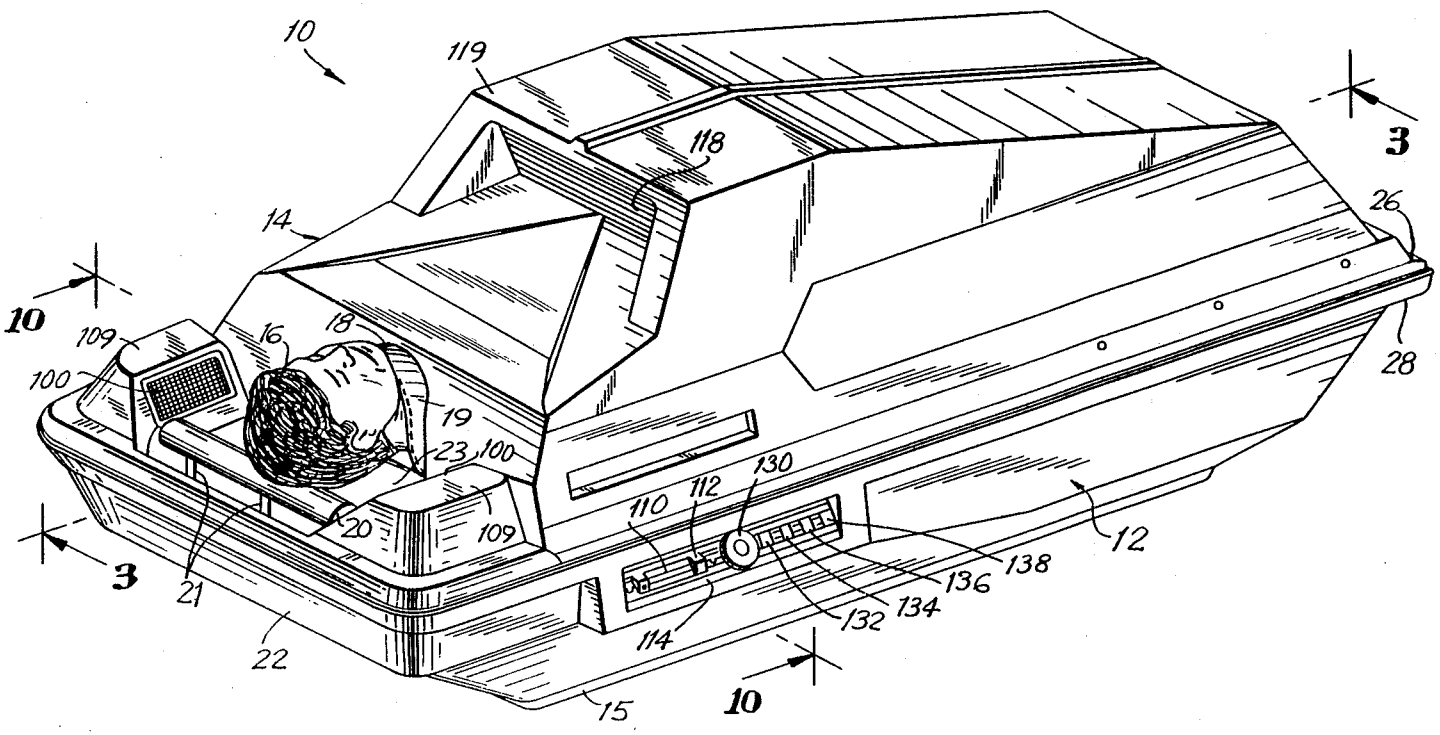
FIG. 1 is a perspective view of the vibrator sauna in a closed, or use, position with a sauna user shown.

Reference is now made specifically to the drawings in which identical or similar parts are designated by the same reference numerals throughout.

FIG.1 illustrates a vibratory sauna 10 including a lower housing 12 and a upper closure member, or cover 14 made of plastic or fiberglass that is attached to one end of the top of lower housing 12. Lower housing 12 includes a horizontal base portion 15 that in turn rests upon a support surface such as a table or floor. The head 16 of a person using the sauna is shown extending from a head hole 18 formed at the bottom edge of one end of cover 14. A towel 19 is removably attached to the inside surface of cover 14. Head 16 rests upon a headrest 20 that lies upon a longitudinal extension 22 of lower housing 12, in particular upon a flat top wall 23. Headrest 20 can be adjusted by positioning slidable vertical supports 21. Upper and lower peripheral flanges 26 and 28 extending outwardly from cover 14 and lower housing 12, respectively, are in close connecting relationship. A lip 2 extends downwardly around the rim of upper flange 25 and over the rim of lower flange 28. A rubber sealing strip 30 secured to the underside of upper flange 26 rests upon lower flange 28 so as to generally seal cover 14 with lower housing 12 from the passage of air in the closed position of sauna 10 shown in FIG. 1.

Figure 2:
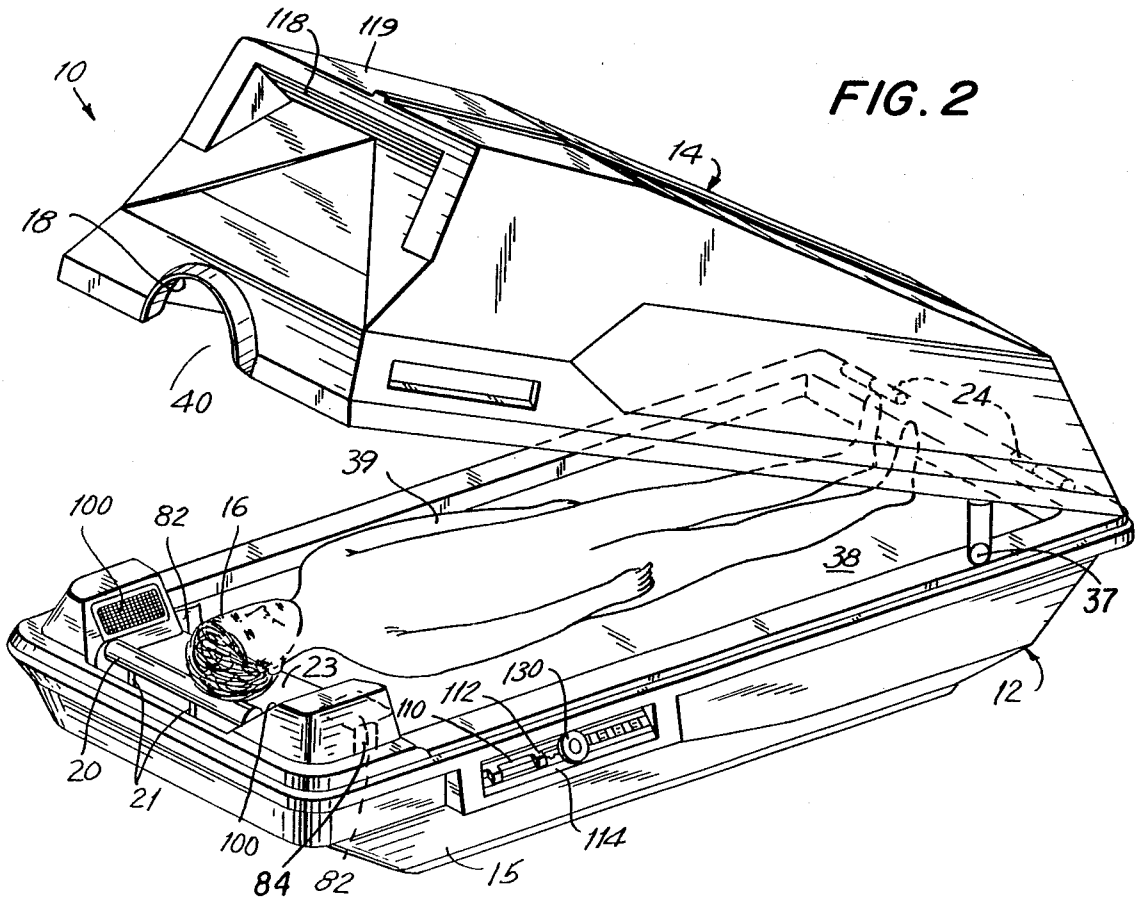
FIG. 2 is a perspective view of the vibrator sauna in an open, or non-use, position with the sauna user shown.

FIG. 2 illustrates vibratory sauna 10 in the open position with cover 14 rotated upwardly from lower housing 12 about hinges 24 that connect lower housing 12 with cover 14 at the end opposite the head end of lower housing 12. A pair of gas struts, or air cylinders, 37 are positioned at the foot end of sauna 10. In particular, the cylinder portions are secured to cover 14 and the piston portions to lower housing 12. Air cylinders 37 are activated and deactivated in a manner known in the art.

Figure 3:
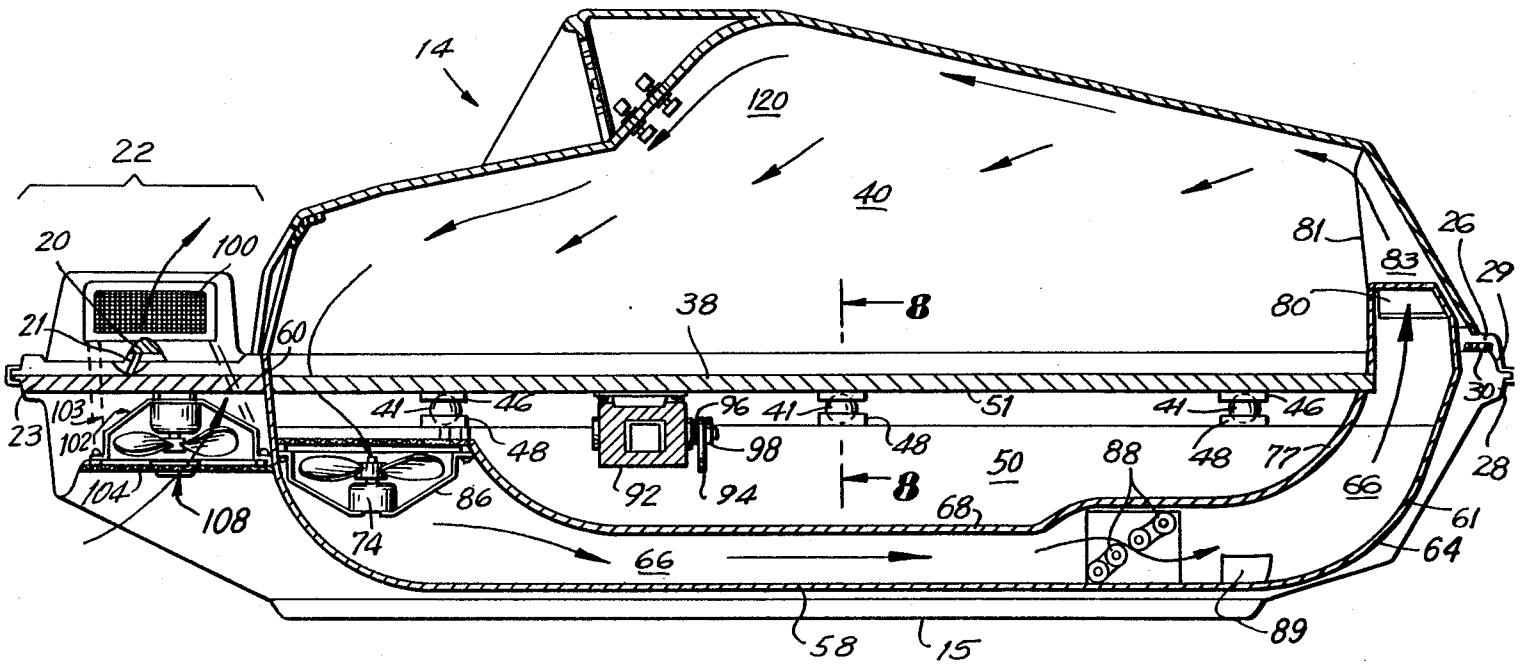
FIG. 3 is a side sectional view taken through plane 3—3 of FIG. 1.
Figure 7:
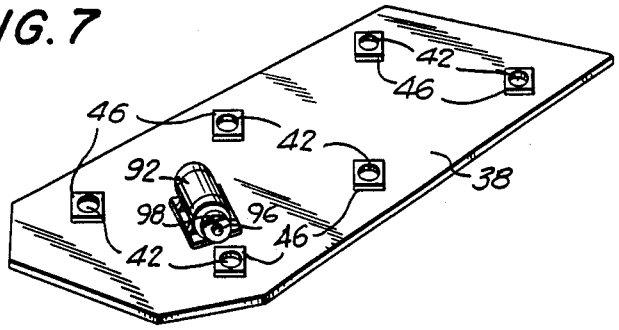
FIG. 7 is an upside down view of the body board showing the mounting members for the balls and showing the vibrator, including the electric motor.
Figure 8:
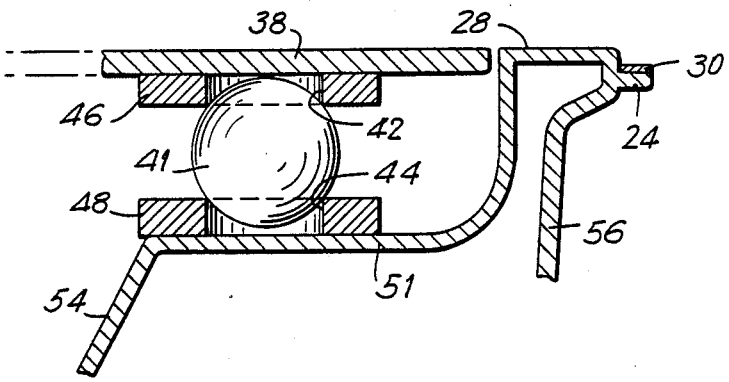
FIG. 8 is a sectional view of a ball and mountings taken through line 8—8 of FIG. 3.

An elongate body support plate, or member, 38 seen in FIGS. 2 and 3 is positioned in a horizontal plane at the top of lower housing 12. Support member 38 supports torso 39 as seen in FIG. 2. Horizontal top wall 23 of extension member 22 and elongate support member 38 lie in the same horizontal plane. Cover 14 forms an upper compartment 40 that encloses torso 39 when cover 14 is closed as seen in FIGS. 1 and 3. Support member 38 rests upon a resilient spring or material such as resilient balls 41, which are positioned in upper and lower recesses, or sockets, 42 and 44, respectively, formed in upper and lower mounting members 46 and 48, respectively, shown in detail in FIGS. 7 and 8. Balls 41 are positioned along the opposed longitudinal edges of elongate support member 38 at generally equal intervals.

Figure 4:
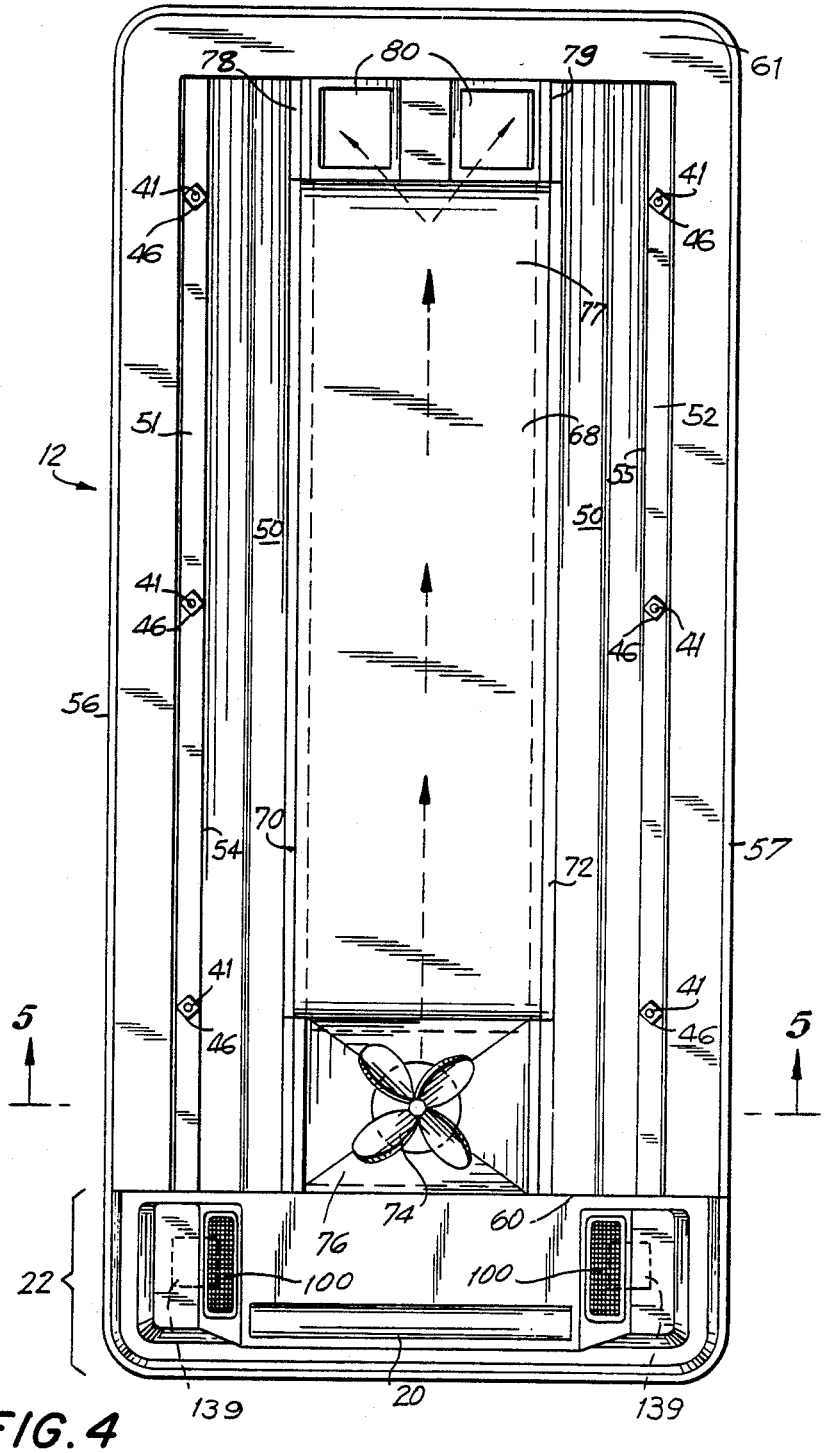
FIG. 4 is a top view of the lower housing with the body board removed.
Figure 5:
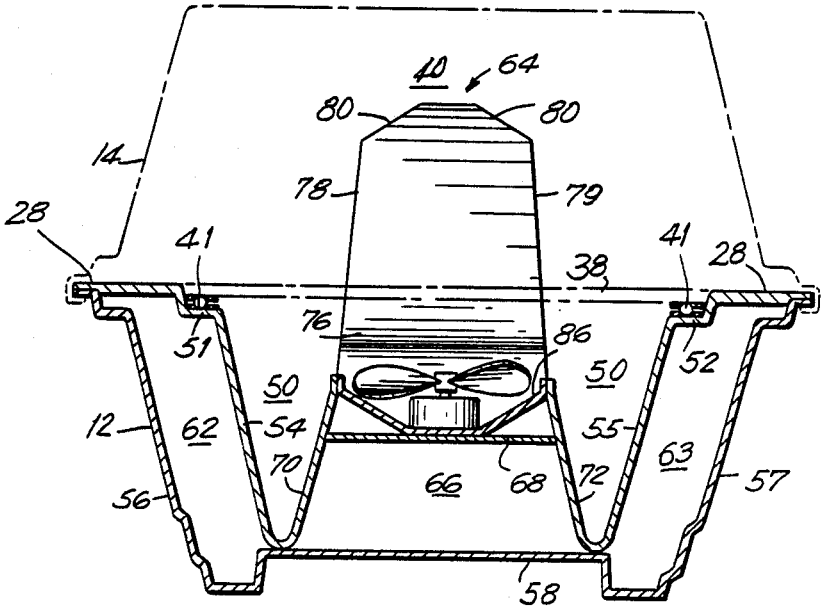
FIG. 5 is a sectional view taken through line 5—5 of FIG. 4 with the body board and the cover indicated in phantom line.

As seen best in FIGS. 4 and 5, lower housing 12 forms a lower chamber 50 and includes a pair of oppositely positioned longitudinal horizontal support surfaces, or shelves, 51 and 52 that extend inwardly into chamber 50 from a pair of opposed inner longitudinal side walls 54 and 55 that in turn extend downwardly at a slight angle inwardly from flange 28 to connection with bottom wall 58. Also extending downwardly from flange 28 are opposed outer side walls 56 and 57 which are spaced from inner side walls 54 and 5 respectively. Opposed air spaces 62 and 63 are formed between inner and outer side walls 56 and 57. Shelves 51 and 52 support lower mounting member 48 and thus elongate support member 38 by way of balls 41. Lower chamber 50, which is opposed to upper chamber 40, is defined in part by bottom wall 58, head-end wall 60 opposed foot-end wall 61 of lower housing 12 and inner vertical walls 54 and 55 that extend downwardly from shelves 51 and 52 to bottom wall 58. Head-end wall 60 separates chamber 50 from lower extending portion 22. Inner vertical walls 62 and 63 angle slightly inwardly for efficiency of manufacture.

Figure 6:
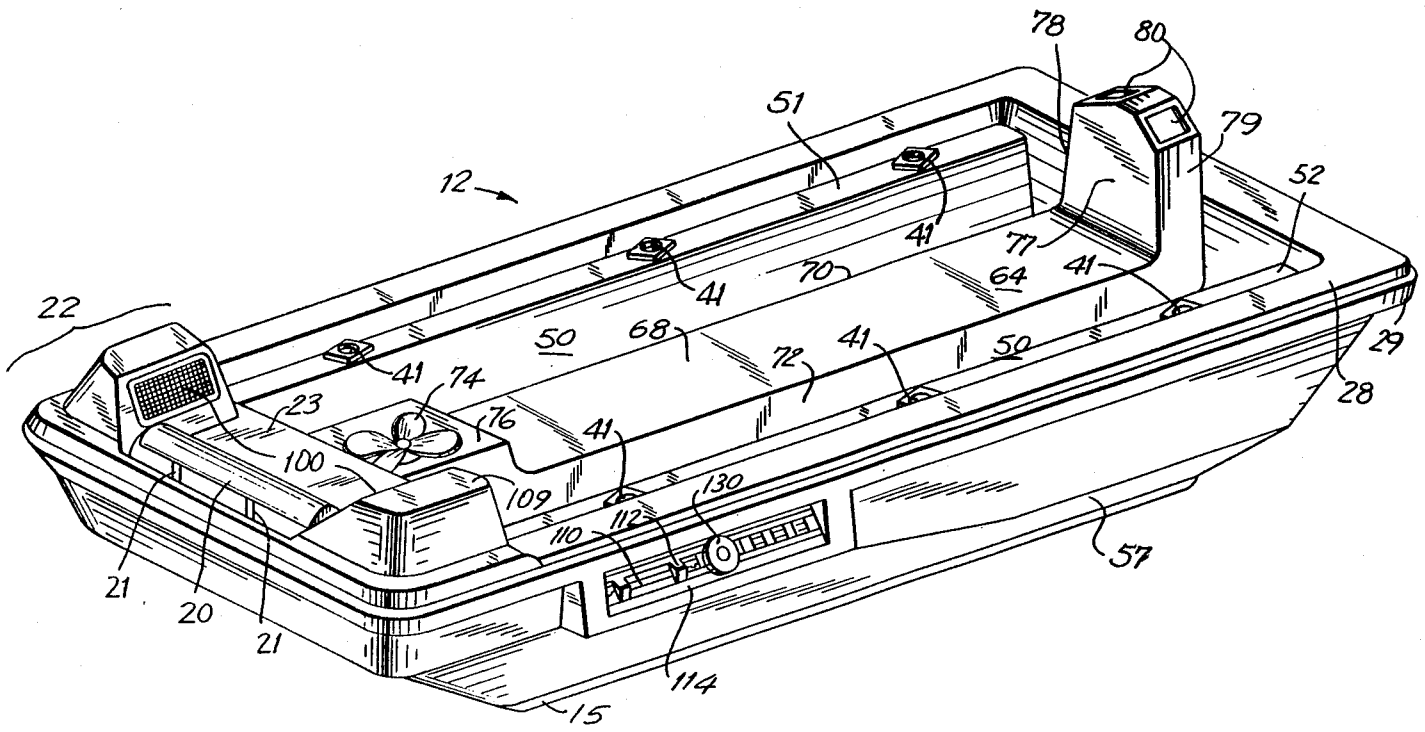
FIG. 6 is a perspective view of the lower housing with the body board removed.

A continuous hot air circulation path moves hot air in a foot-to-neck direction relative to the person lying on elongate support member 38. This movement of hot air is shown by arrows in FIGS. 3 and 4. As seen in FIGS. 3, 4, 5 and best in FIGS. 6, a portion of the hot air path is ducting 64, a generally rectangular structure that forms a hot air flow chamber, or duct, 66 between head wall 60 and foot wall 61. The mid-portion of duct 66 is defined by a top wall 68, a pair of opposed side walls 70 and 72 and bottom wall 58 of lower housing 12. Side walls 70 and 72 angle outwardly to bottom wall 58 for efficiency of manufacture. A hot-air fan, or blower, 74 is positioned at the upstream end of duct 66 at head wall 60. Blower 74 has a topside opening 76 spaced below elongate support member 38. The downstream end of ducting 64 curves upwardly at foot wall 61 where duct 66 is defined by an upwardly curved wall 77 and upwardly curved side walls 78 and 79 that are continuations of top wall 68 and side walls 70 and 72, respectively. A pair of spaced outlets 80 formed at the top end of duct 66 opens into upper chamber 40.

A cowling 81 attached to the undersurface of the foot end of cover 14 forms a passage, or chimney, 83 that passes air from its inlet to its outlet at the roof of cover 14. When cover 14 is raised, cowling 81 pulls away from coextensive arrangement with spaced outlets 80. Hot air is directed by cowling 81 away from the feet of the person using the sauna during operation. A pair of triangular bevel passages 82 cut from the head side of elongate support member 38 lead to a pair of head-end ducts 84. Elongate support member 38 is set closely to side walls 54 and 55 of lower housing 12 sufficiently to avoid frictional resistance during vibration of member 38. Hot air will generally not enter lower chamber 50 but will be drawn over torso 39 to the suction side of blower 74. Blower 74 is attached to a blower housing 86 that is hung from the inner surfaces of the upstream end of air ducting 64. Air is forced through a passage in heating coils 88 that are positioned at the downstream portion of duct 66. It is to be particularly noted that the position of blower 74 and bevel passages 82 causes the hot air to be passed directly over the shoulders of the person in the sauna. The hot air becomes relatively unheated by the time it passes over the torso of the person using the sauna. A humidifier 89 is positioned in duct 66 immediately downstream of heating coils 88. Humidifier 89 can comprise a container which contains water with a sheet of absorbent material known in the art.

A lower housing chamber 50 is formed by lower housing 12, elongate support member 38, duct top wall 68, vertical side walls 54 and 55, and of lower housing 12, and side walls 70 and 72 of ducting 64, head wall 60, and foot wall 61.

Figure 9:
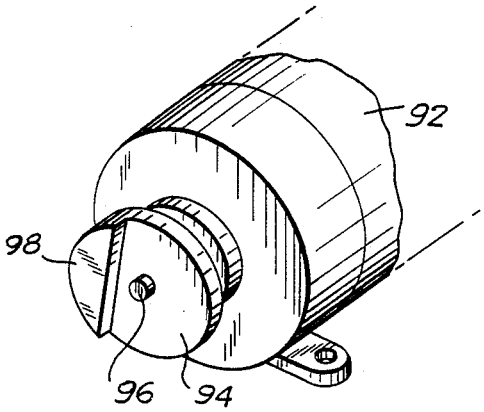
FIG. 9 is a perspective view taken in isolation of a vibrator including an electric motor and an eccentric.

As shown in FIGS. 3 and 9, a vibrator device including an electric motor 92 is rigidly attached to the underside of elongate support member 38. A cylindrical mounting member 94 is axially connected to the drive shaft 96 of motor 92, and a vibration member, or eccentric, 98 is attached to mounting member 94 so as to cause vibration of elongate support member 38, which, as previously described, is resiliently mounted on balls 41. This produces a gentle vibration which has a soothing and relaxing effect on the person using the sauna. Other devices can be used to induce vibrations to elongate support member 38. For example, an induction coil apparatus could be used.

As seen in FIGS. 1, 2, 3, 4, and 10, a pair of opposed faces vents positioned on either side of head 16 also act as grill speakers, the combined vent/grill being designated by numeral 100. A fresh air face fan 102 is positioned in ducting 103 positioned below extension portion 22 of lower housing 12 under head rest 20. Air drawn in through a bottom inlet hole 104 formed in ducting 103 is drawn upwards by face fan 102 through a pair of opposed short ducts 106 positioned in longitudinal extension 22 to face fan 102 and from there to vent/grill 100. Longitudinal extension 22 includes a flat top side 107. A pair of protective enclosure 109 extend upwardly from top side 107 so as to protect the raised outlet ends of short ducts 106 and face vents/speakers grills 100.

Figure 10:
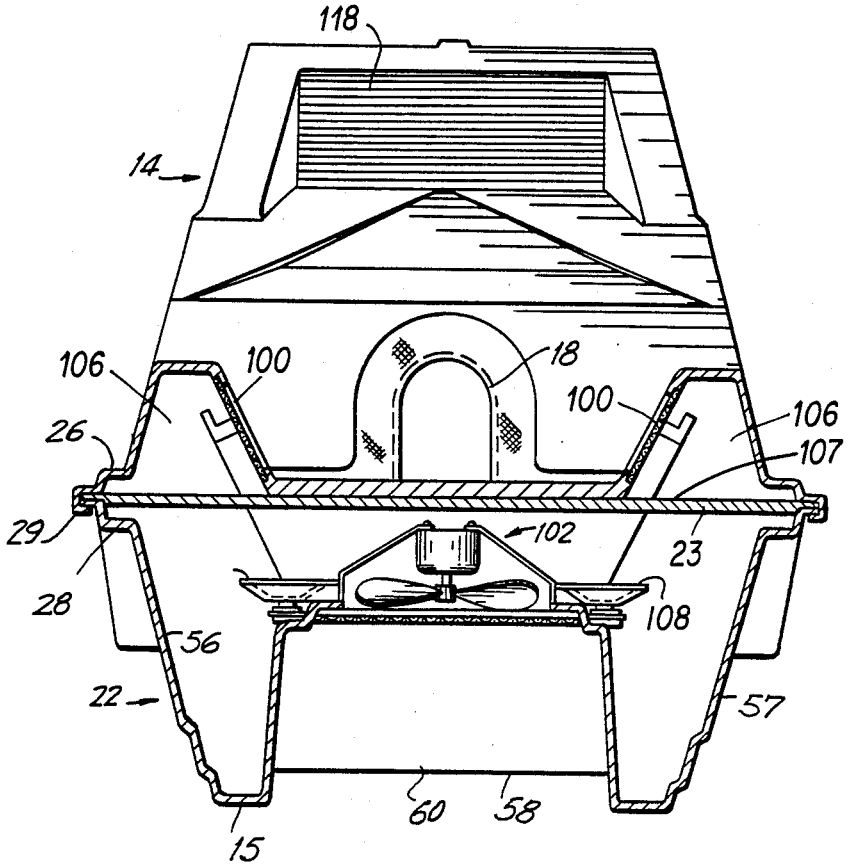
FIG. 10 is an end sectional view taken through plane 10—10 of FIG. 1.

As seen best in FIGS. 3 and 10, a pair of stereo speakers 108 are positioned below longitudinal extension 22 outwardly on either side of face fan 102. The audio path of the sound follows the paths of short ducts 106 to vent/grill 100.

As seen in FIGS. 1 and 2, a radio 110 and/or a cassette player 112 are positioned in a recess 114 formed along the external underside of lower housing 12. Controls for radio 110 and cassette player 112 are also positioned in recess 114.

Figure 11:
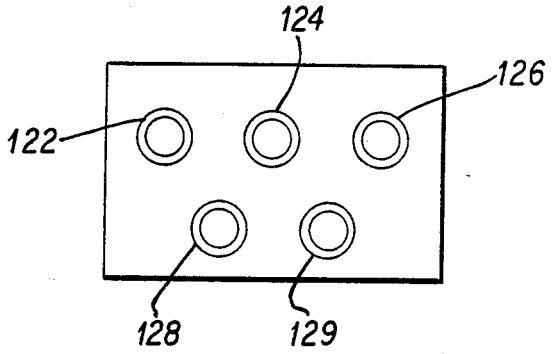
FIG. 11 is a view of the inner control panel taken in isolation.

A display panel 118 transversely situated across a raised top portion wall 119 of cover 14 is positioned within easy viewing by the person using the sauna, that is, within viewing of head 16. The upper portion of cover 14 forms a raised curved hollow 120 at the head portion of which, proximate to display panel 118, five internal control knobs are situated, namely. internal control knobs 122, 124, 126, 128, and 129 for the hot air blower 74, heating coils 88, electric motor 92, the sound stereo/radio 110/112, and face fan 102, respectively. As seen in detail FIG. 11, the internal control knobs lie directly above the upper part of torso 3 and thus are within easy reach of the person using the sauna. The external control knobs 130, 132, 134, 136 and 138 for blower 74, heating coils 88, motor 92 radio/cassette 110/112, and face fan 102, respectively, are positioned in recess 114 adjacent radio 110 and cassette 112.

A pair of air purifying means, such as negative ion injectors 139 are positioned in protective enclosures 109. Ion injectors 139 are schematically indicated in FIG. 4, and may include air filters (not shown).

Figure 12:
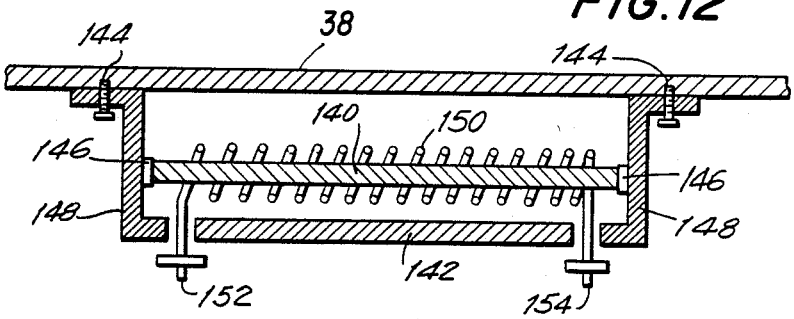
FIG. 12 is a sectional view of a vibrator including a core member positioned in an induction coil.
Figure 13:
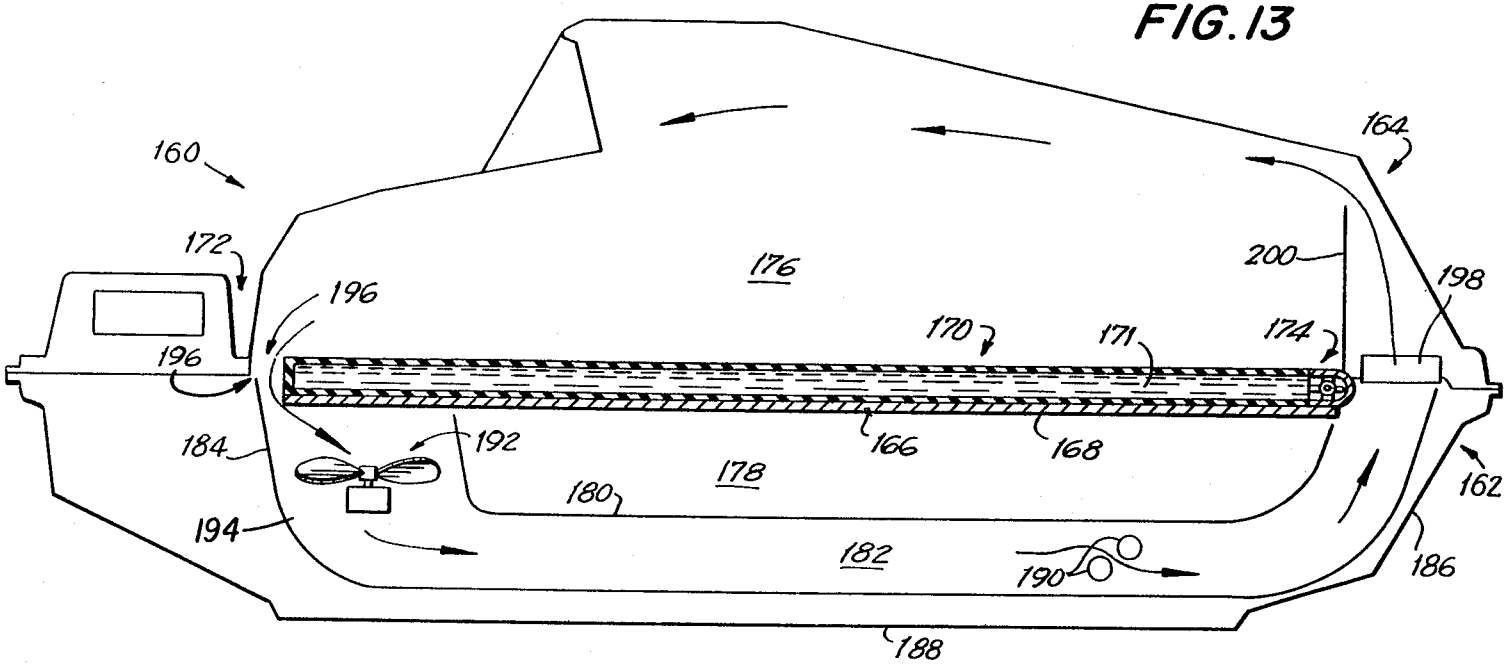
FIG. 13 is a partly schematic sectional view of a sauna including a water bed.

Another embodiment of the vibrator device is shown in FIG. 12. A horizontal, elongated core member 140 made of a magnetizable metal is disposed in a housing 142 rigidly attached to the underside of support member 38 by bolts 144. The opposed ends of core member 140 are secured to end mounts 146 in turn secured to the inner surfaces of vertical side walls 148 of housing 142. A cylindrical induction coil 150 is positioned around core number 140 with end leads 152 and 154 to a source of alternating current. Core member 140 will be drawn back and forth along with housing 142, which in turn vibrates support member 38 when the vibration device is activated. Another embodiment of the present invention of the vibratory sauna is shown in FIG. 13 as sauna 160. A housing including lower housing member 162 and an upper closure member, or cover, 164 is illustrated in the closed position. An elongated support member 166 is positioned in a horizontal plane at the top of lower housing member 162 lying on a shelf 168 formed by lower housing member 162. A water bed 170 containing water 171 positioned on support member 166 is capable of supporting the torso of a person in a supine position. A headrest, or head support, 172 is located adjacent lower housing member 162 outwardly of cover 164 to form a longitudinal extension of support member 166.

A vibration mechanism 174 operatively connected to a water bed 170 capable of vibrating water 171 is positioned at the foot end of housing 142. Cover 164 forms an upper compartment 176; the torso (not shown) of a person using the sauna is positioned in compartment 176. Lower housing member 162 forms a chamber 178 below support member 166 analogous to chamber 50 of vibratory sauna 10 shown in FIGS. 3, 4, 5 and 6. Ducting 180 forms a hot air flow chamber, or duct, 182 between head wall 184 and foot wall 186 along bottom wall 188 of lower housing member 162. Hot air heating coils 190 are positioned in duct 182. A blower 192 is positioned at the inlet end 194 of duct 182 at head wall 184. Unheated air from upper compartment 176 is drawn through outlet ports 196 formed between support member 166 and head wall 184 at the head end of water bed 170. Outlet ports 196 are positioned at the sides of water bed 170 so that the hot air passes over the shoulders of the person lying on water bed 170. It is noted that the heated air in compartment 176 becomes relatively unheated by the time it has passed the person on the water bed. The now unheated air is drawn through outlet ports 196 to the suction end of blower 192 into duct 182 to the upstream end of duct 182 to spaced outlets 198 and cowling 200 attached to cover 164 and fitted over outlets 198. Cowling 200 is raised from outlets 198 when cover 164 is raised. Hot air is drawn from the cowling outlet through compartment 176 over the torso of the person on water bed 170 to blower 192 to complete a longitudinal continuous closed circulation loop of air in lower housing member 162 of sauna 160 while water bed 170 is simultaneously vibrated.

Figure 14:
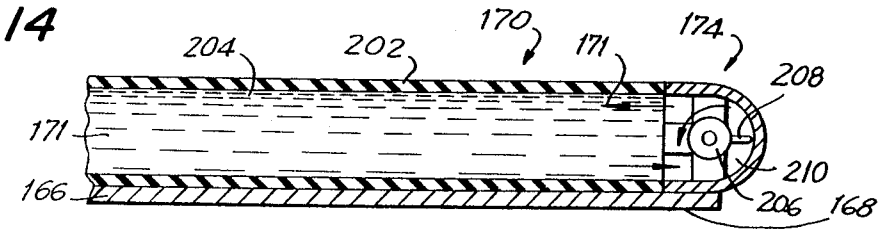
FIG. 14 is a detailed sectional view of a pulsating mechanism for the water bed.

FIG. 14 shows vibration mechanism 174 in more detail. Water bed 170 includes a flexible, water proof plastic skin 202 which forms a bag 204 containing water 171. It is to be noted that water 171 may be any suitable liquid. Vibration mechanism 174 positioned at the foot end of sauna 160 includes a rotary driver suitably mounted to lower housing member 162 having at least one blade 208 capable of moving water 171 through a U-channel 210 fluidly connected to bag 204 so that continuous rhythymical vibrations and pulsations are created in water 171. More than one blade 208 may be mounted to rotary driver 206.

The embodiment of the invention particularly described and disclosed herein is presented merely as an example of the invention. Other embodiments, forms, and modifications of the invention coming within the proper scope and spirit of the appended claims will, of course, readily suggest themselves to those skilled in the art.

What is claimed is:

1. A vibratory sauna comprising:

a housing including a lower housing member and an upper closure member forming a cover member rotatably connected to said lower housing member, said lower housing member including a base, a support member mounted on said lower housing member oriented in a substantially horizontal plane for supporting the torso of a person in a supine position, head support means located adjacent said lower housing member and outwardly of said closure member to form a longitudinal extension of said support member, resilient mounting means positioned in said lower housing member for supporting said support member, vibration means operatively connected to said support member for vibrating said support member, said cover member forming an upper compartment, said torso being positioned in said compartment, said lower housing member forming a chamber below said support member, heating means for heating ambient air, airflow generation means for forcing heated and unheated air, and chamber means having an inlet end and an opposite outlet end positioned within and sealed from said chamber, said heating means being positioned in said chamber means and said airflow generation means being associated with an inlet and of said chamber means, said chamber means being for receiving ambient air from said compartment at said inlet end and passing said ambient air to an opposite outlet end back to said compartment in a flow of air as one part of a continuous closed circulation loop of air in said housing, said loop including a flow of heated air above said support member to contact said person lying thereon while said support member is adapted to be simultaneously vibrated, the flow of heated air above said person including the other part of said continuous circulation loop.

2. A vibratory sauna as claimed in claim 1, wherein said closure member is a cover hingedly mounted to said lower housing member at an end of said housing opposite to said head support means.

3. A vibratory sauna as claimed in claim 2, wherein said support member is an elongate member.

4. A vibratory sauna as claimed in claim 3, wherein said vibration means includes a housing rigidly attached to the underside of said elongate member, a core member rigidly secured to said housing, an induction coil positioned around said core member, a source of alternating current, and means for connecting said induction coil with said source of alternating current.

5. A vibratory sauna as claimed in claim 3, wherein said core member is generally horizontal.

6. A vibratory sauna comprising:

a housing including a lower housing member and an upper closure member forming a cover member rotatably connected to said lower housing member, said lower housing member including a base, an elongated support member mounted on said lower housing member oriented in a substantially horizontal plane, a bed container holding a liquid positioned on said support member and capable of supporting the torso of a person in a supine position, head support means located adjacent said lower housing member and outwardly of said closure member to form a longitudinal extension of said support member, vibration means in the form of a pulsating pump operatively connected to said liquid in said bed container for creating rhythmical pulsating in said liquid in said bed container, said cover member forming a upper compartment, said torso being positioned in said compartment, said lower housing member forming a chamber below said support member, heating means for heating ambient air, air flow generation means for forcing heating and ambient air, and chamber means having an inlet end and an opposite outlet end positioned within and mounted in said chamber, said heating means being positioned in said chamber means and said airflow generation means being associated with an inlet end of said chamber means, said chamber means being for receiving ambient air from said compartment at said inlet end, and passing said ambient air to an opposite outlet end back to said compartment in a flow of air as one part of a continuous closed circulation loop of air in said housing, said loop including a flow of heated air above said support member to contact said person lying thereon while said liquid in said bed container is adapted to be simultaneously pulsated, the flow of heated air above said person including the other part of said continuous circulation loop.

7. A vibratory sauna as claimed in claim 6, wherein said vibratory means is a pulsating pump operatively connected to said liquid in said bed container.

8. A sauna comprising:

a housing including a lower housing member and an upper closure member forming a cover member rotatably connected to said lower housing member, said lower housing member including a base, a support member mounted on said lower housing member oriented in a substantially horizontal plane for supporting the torso of a person in a supine position, head support means located adjacent to said lower housing member and outwardly of said closure member to form a longitudinal extension of said support member, said cover member forming an upper compartment, said torso being positioned in said compartment, said lower housing member forming a chamber below said support member, heating means for heating ambient air, airflow generation means for forcing heated and ambient air, and chamber means positioned within and sealed from said chamber, said heating means being positioned in said chamber means, and said airflow generation means being associated with at least one inlet and at least one outlet of said chamber means, said chamber means being for receiving ambient air from said compartment at said inlet and passing said ambient air to said outlet back to said compartment in a flow of air as one part of a continuous closed circulation of air in said housing, said continuous closed circulation including a flow of heated air above said support member to contact the person lying thereon while said support member is adapted to be simultaneously vibrated, the other part of said continuous closed circulation of air being a flow of heated air above the person.

9. A sauna as claimed in claim 8 wherein said closure member is a cover hingedly mounted to said lower housing member.

10. A sauna as claimed in claim 9 wherein said support member is an elongate member.

11. A sauna as claimed in claim 10 wherein said lower housing member includes opposed longitudinal side walls and a pair of opposed longitudinal horizontal shelves extending from said longitudinal side walls into said chamber, said elongated member being generally positioned and held by said pair of shelves.

12. A sauna as claimed in claim 14 wherein said chamber means includes ducting having a generally horizontal portion in said chamber, said ducting forming a duct portion adapted to pass air from said airflow generation means.

13. A sauna as claimed in claim 12 wherein said duct portion opens to said at least one inlet and to said at least one outlet of said chamber, said airflow generation means being positioned below said elongate member at said at least one inlet so that cooled air from said compartment is drawn into said inlet at the suction side of said airflow generation means.

14. A sauna as claimed in claim 13 further including a face fan and fresh air ducting associated with said head support means, said fresh air ducting having at least one inlet side and at least one outlet side directed toward the head of the person.

15. A vibratory sauna comprising:

a housing including a lower housing member and an upper closure member forming a cover member rotatably connected to said lower housing member, said lower housing member including a base, a support member mounted on said lower housing member oriented in a substantially horizontal plane for supporting the torso of a person in a supine position, head support means located adjacent to said lower housing member and outwardly of said closure member to form a longitudinal extension of said support member, resilient mounting means positioned in said lower housing member for supporting said support member, vibration means operatively connected to said support member for vibrating said support member, said cover member forming an upper compartment, said torso being positioned in said compartment, said lower housing member forming a chamber below said support member, airflow generation means for forcing air, humidifying means positioned downstream of said airflow generation means for moistening the air being forced, and chamber means positioned within and sealed from said chamber, said airflow generation means being associated with at least one inlet and at least one outlet of said chamber means, said chamber means being for receiving air from said compartment via said airflow generation means at said inlet and passing the air to said outlet back to said compartment in a general flow of air as one part of a continuous closed circulation of air in said housing, said continuous closed circulation including a flow of air above said support member to contact the person lying thereon while said support member is adapted to be simultaneously vibrated, the other part of said continuous closed circulation of air being a flow of air above the person.

16. A vibratory sauna as claimed in claim 15, wherein said closure member is a cover hingedly mounted to said lower housing member.

17. A vibratory sauna as claimed in claim 16, wherein said support member is an elongate member.

18. A vibratory sauna as claimed in claim 17, wherein said lower housing member includes opposed longitudinal side walls and a pair of opposed longitudinal shelves extending from said longitudinal side walls into said chamber, said elongated member being generally positioned and held by said pair of shelves.

19. A vibratory sauna as claimed in claim 18, wherein said chamber means includes ducting having a generally horizontal portion in said chamber, said ducting forming a duct adapted to pass air from said airflow generation means.

20. A vibratory sauna as claimed in claim 19, wherein said duct portion opens to said at least one inlet and to said at least one outlet of said chamber, said airflow generation means being positioned below said elongate member at said at least one inlet so that air from said compartment is drawn into said inlet at the suction side of said airflow generation means.

* * * * *